US005901570A

United States Patent [19]

Sin

[11] Patent Number: 5,901,570

[45] Date of Patent: May 11, 1999

[54] REFRIGERATOR HAVING A REFRIGERATION SYSTEM

[75] Inventor: Jun-Chul Sin, Incheon, Rep. of Korea

[73] Assignee: Daewoo Electronics Co., Ltd., Rep. of Korea

[21] Appl. No.: 08/994,657

[22] Filed: Dec. 19, 1997

[30] Foreign Application Priority Data

Jun. 30, 1997 [KR] Rep. of Korea ..... 97-28967
Jun. 30, 1997 [KR] Rep. of Korea ..... 97-28968

[51] Int. Cl.[6] ..... F25D 17/04

[52] U.S. Cl. ..... 62/407; 62/276; 165/125

[58] Field of Search ..... 62/404, 407, 408, 62/272, 275, 276; 165/496, 163, 172, 125

[56] References Cited

U.S. PATENT DOCUMENTS 2,001,832 5/1935 Bandurski ..... 165/125
2,044,832 5/1936 Child ..... 165/125
5,241,838 9/1993 Kennedy .

*Primary Examiner*—John M. Sollecito
*Attorney, Agent, or Firm*—Cushman Darby & Cushman Intellectual Property Group of Pillsbury Madison & Sutro, LLP

[57] ABSTRACT

A refrigerator for improving a cooling efficiency. The refrigerator has a cabinet having a refrigerating chamber, a freezing chamber, and an evaporator chamber which is disposed at a rear portion of the freezing chamber, an evaporators which generates a chilled air and has a helical shape forming a conical space portion therein, a blower assembly coaxially disposed at a rear of the evaporator so as to blow an air towards the evaporator, and a heater installed in the conical space portion of the evaporator so as to remove a frost adhering to the evaporator. The refrigerator can effectively make a heat-exchange between the evaporator and the air so that the cooling efficiency is improved. Since the turbulent air flow is introduced into the freezing chamber, the freezing chamber can be uniformly cooled and since the heater is coaxially disposed in the evaporator, the heater can uniformly heat the evaporator, so the defrosting a frost from the evaporator is effectively carried out.

17 Claims, 6 Drawing Sheets

REFRIGERATOR HAVING A REFRIGERATION SYSTEM

BACKGROUND OF THE INVENTION

1. Field of the Invention

The present invention relates to a refrigerator, and more particularly to a refrigerator having a refrigeration system which can improve a cooling efficiency.

2. Description of the Prior Art

Generally, a refrigerator is an apparatus for storing various foodstuffs in either a frozen or a refrigerated condition to extend the freshness of the foodstuffs for a long time. Such a refrigerator includes a compressor which circulates a refrigerant by compressing the refrigerant, a condenser for condensing the refrigerant to a liquid phase, and an evaporator for generating a chilled air by evaporating the liquid phase refrigerant.

The refrigerator has a freezing chamber for storing frozen foods such as meats or an ice cream, and a refrigerating chamber for storing foods at a relatively lower temperature. The chilled air generated by the evaporator is introduced into the refrigerating and freezing chambers by a fan.

FIG. 1 shows a conventional refrigerator 100. As shown in FIG. 1, refrigerator 100 has a refrigerating chamber 2 which is separated from a freezing chamber 1 by a partition wall 3. An evaporator 4 is installed in an evaporator chamber 7 which is formed at a rear portion of freezing chamber 1, and a compressor 6 is installed below refrigerating chamber 2. A condenser (not shown) is disposed between evaporator 4 and compressor 6.

Compressor 6 compresses the refrigerant to a high-pressure and high-temperature refrigerant, and the condenser makes a liquid-phase temperature by discharging a heat from the high-pressure and high-temperature refrigerant. The liquid phase refrigerant is supplied to evaporator 4 and is evaporated by evaporator 4, thereby generating the chilled air. In addition, a heater 9 is installed below evaporator 4 so as to defrost a frost adhering to evaporator 4.

Installed above evaporator 4 is a fan 5 for blowing an air toward evaporator 250. Fan 5 circulates the chilled air into freezing chamber 1 through a first chilled air inlet 41 formed at a rear wall of freezing chamber 1. In addition, some of the chilled air is introduced into refrigerating chamber 2 through a chilled air duct 45 formed at a rear portion of evaporator chamber 7 and through a second chilled air inlet 42 which is formed at a rear wall of refrigerating chamber 2. The chilled air which has been introduced into freezing and refrigerating chambers 1 and 2 is re-circulated into evaporator chamber 7 through first and second chilled air return passages 43 and 44 which are formed at a lower portion of freezing chamber 1 and at an upper portion of refrigerating chamber 2, respectively.

FIG. 2 is an enlarged view of evaporator 4 shown in FIG. 1. As shown in FIG. 2, evaporator 4 includes a bending pipe 46 and heat-exchange plates 47 which are attached to an upper portion of bending pipe 46.

The refrigerant supplied into bending pipe 46 is evaporated therein, thereby absorbing a heat from a periphery thereof. Accordingly, the chilled air is created at the periphery of evaporator 4. At this time, a heat-exchange area between evaporator 4 and the air is increased by heat-exchange plates 47 so that heat-exchange efficiency is improved.

However, in conventional refrigerator 100, a flow direction of the chilled air is constantly formed along the longitudinal direction of plates 47, so the chilled air does not widely make contact with a periphery air, thereby lowering the heat-exchange efficiency.

In other words, the air blown by fan 5 toward evaporator 4 flows in the longitudinal direction of evaporator chamber 7 due to plates 47, so the air does not uniformly make contact with bending pipe 46, so the heat-exchange efficiency between the air and evaporator 4 is reduced.

In order to overcome the above problem, various types of evaporators for improving the heat-exchange efficiency have been suggested, but they have presented problems.

For example, U.S. Pat. No. 5,241,838 issued to Kennedy discloses a refrigeration device which can improve the heat-exchange efficiency. Kennedy's refrigeration device comprises a spine fin which is disposed around a refrigerant pipe and makes a heat-exchange relationship with the refrigerant pipe.

However, since a fan is disposed above an evaporator in Kennedy's refrigeration device, an air blown by the fan does not widely make contact with the evaporator, so the heat-exchange efficiency is relatively reduced.

SUMMARY OF THE INVENTION

The present invention has been made to overcome the above described problem of the prior art. Accordingly, it is an object of the present invention to provide a refrigerator having a refrigeration system in which an evaporator can be effectively heat-exchanged with an air, thereby improving a cooling efficiency.

To accomplish the object of the present invention, there is provided a refrigerator comprising:

- a cabinet having a refrigerating chamber, a freezing chamber which is disposed above the refrigerating chamber and separated from the refrigerating chamber by a first partition wall, and an evaporator chamber which is disposed at a rear portion of the freezing chamber and is separated from the freezing chamber by a second partition wall;
- a first means for generating a chilled air, the first means being disposed in the evaporator chamber and having a helical shape forming a conical space portion therein;
- a second means for blowing an air towards the first means, the second means being coaxially disposed with the first means, the second means being located at a rear of the first means; and
- a third means for removing a frost adhering to the first means, the third means being installed in the conical space portion.

According to the preferred embodiment of the present invention, the first means includes an evaporator comprising a refrigerant pipe having a spiral shape which becomes larger toward the second partition wall, at least one upper bracket coupled to an upper portion of the refrigerant pipe for supporting the refrigerant pipe, at least one lower bracket coupled to a lower portion of the refrigerant pipe for supporting the refrigerant pipe, and a plurality of heat exchange pins which are disposed around the refrigerant pipe in a longitudinal direction thereof.

The second means includes a motor having a rotating shaft, and a fan which is coupled to the rotating shaft and is driven by the motor.

The third means includes a heater which is coaxially disposed with the evaporator.

When an electric power is applied to the refrigerator, a liquid phase refrigerant is supplied into the evaporator. The liquid phase refrigerant is evaporated in the refrigerant pipe, thereby absorbing a heat from periphery thereof. As a result, the chilled air is created in the periphery of the evaporator.

At the same time, the fan blows the air towards the evaporator, the air blown by the fan widely makes contact with the evaporator. At this time, due to the helical shape of the evaporator, some of the air may rotate about a central axis of the refrigerant pipe. Accordingly, a turbulent air flow is generated when the air passes through the evaporator, so the air further uniformly makes contact with the evaporator 310.

As a result, the chilled air created by a heat-exchange between the evaporator and the air is supplied into the freezing chamber. At this time, since the turbulent chilled air is supplied to the freezing chamber, the freezing chamber can be uniformly cooled.

While the refrigerating cycle is being carried out, if it is required to remove the frost adhering to the evaporator, an electrical control unit sends an operating signal to the heater so as to operate the heater. Since the heater is coaxially disposed in the evaporator, the heater can uniformly distribute a heat toward the evaporator, so the frost adhering to the evaporator is effectively defrosted.

As described above, the refrigeration system according to the present invention can effectively make a heat-exchange between the evaporator and the air so that the cooling efficiency is improved.

In addition, since the turbulent air flow is introduced into the freezing chamber, the freezing chamber can be uniformly cooled. Further, since the heater is coaxially disposed in the evaporator, the heater can uniformly heat the evaporator, so the defrosting of the frost from the evaporator is effectively carried out.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a preferred embodiment of the present invention will be explained in detail with reference to the accompanying drawings.

Figure 1:
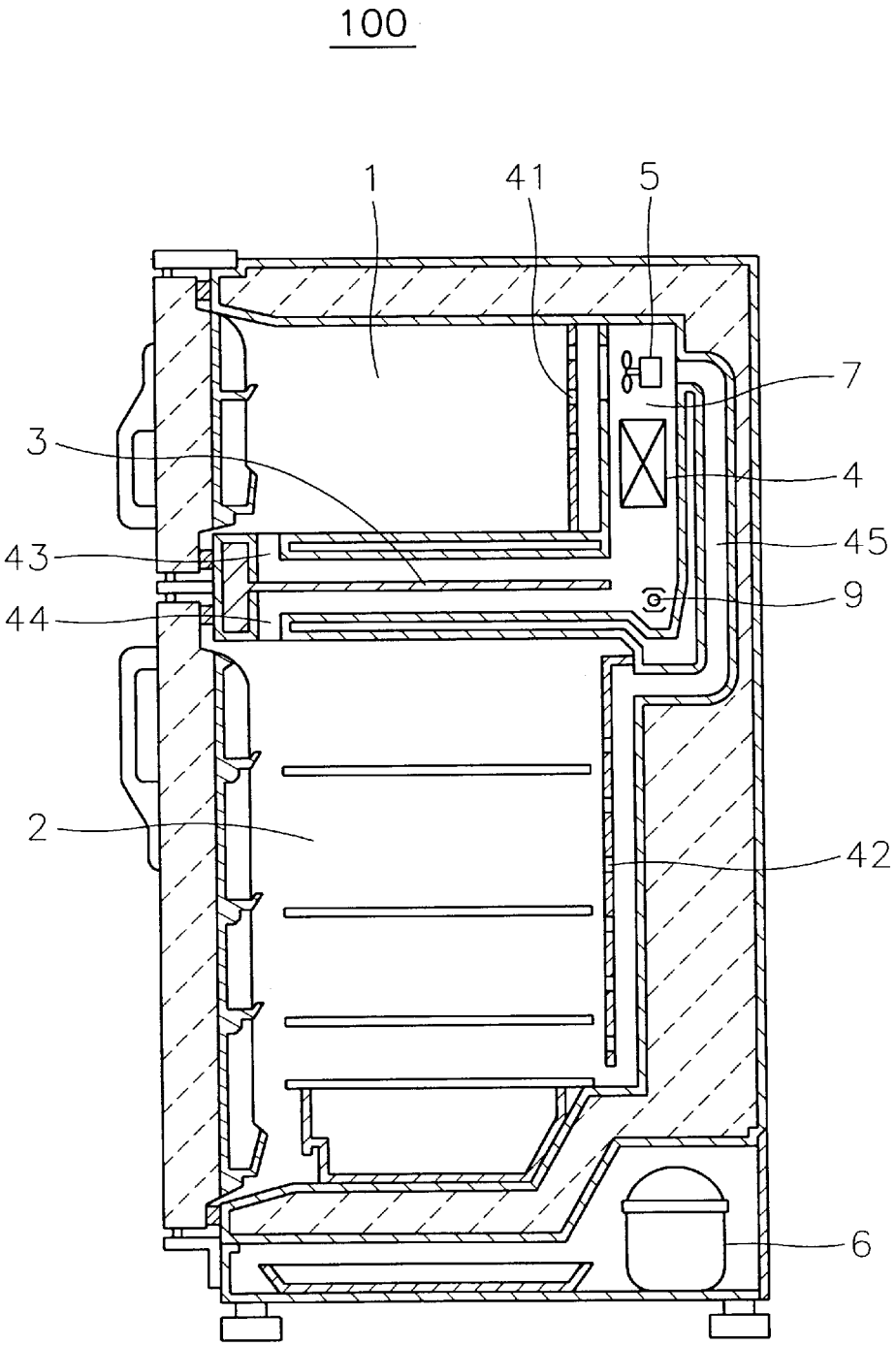
FIG. 1 (PRIOR ART)
FIG. 1 is a sectional view showing the structure of a conventional refrigerator.
Figure 2:
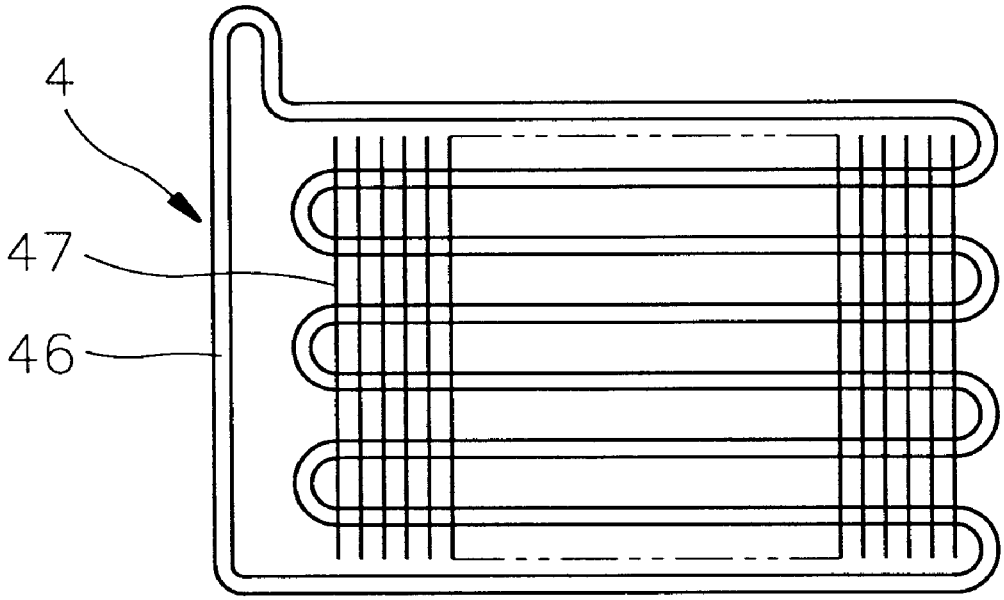
FIG. 2 (PRIOR ART)
FIG. 2 is a sectional view showing a conventional evaporator.
Figure 3:
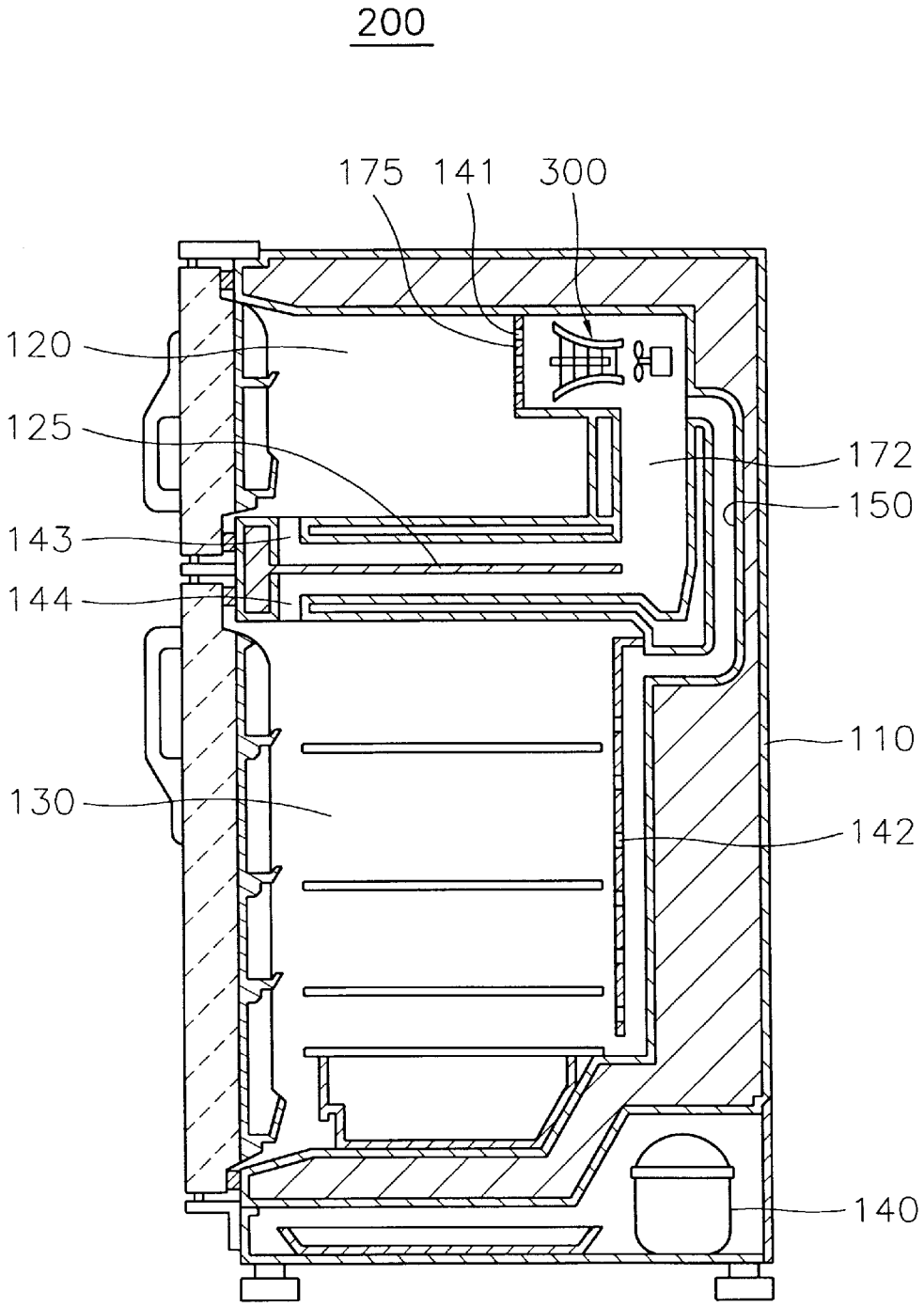
FIG. 3 is a sectional view of a refrigerator having a refrigeration system according to the first embodiment of the present invention.

FIG. 3 shows a refrigerator 200 having a refrigeration system 300 therein. As shown in FIG. 3, refrigerator 200 comprises a cabinet 110 having a refrigerating chamber 130 and a freezing chamber 120 which is separated from refrigerating chamber 130 by a first partition wall 125. An evaporator chamber 172 is disposed at a rear portion of freezing chamber 120 and is separated from freezing chamber 120 by a second partition wall 175. Refrigeration system 300 according to the present invention is installed in evaporator chamber 172. Refrigeration system 300 will be detailedly explained below with reference to FIGS. 4 to 6.

Second partition wall 175 is formed with a first chilled air inlet 141 for guiding a chilled air generated in evaporator chamber 172 into freezing chamber 120. In addition, the chilled air is also guided into refrigerating chamber 130 through a chilled air duct 150 formed at a rear portion of evaporator chamber 172 and a second chilled air inlet 142 formed at a rear wall of refrigerating chamber 130. The chilled air introduced into freezing and refrigerating chambers 120 and 130 is recirculated into evaporator chamber 172 through first and second chilled air return passages 143 and 144 which are formed at a lower portion of freezing chamber 120 and at an upper portion of refrigerating chamber 130, respectively.

On the other hand, a compressor 140 for compressing a refrigerant gas to a high-pressure and high-temperature refrigerant gas is disposed below refrigerating chamber 130. A condenser for condensing the refrigerant gas is connected between compressor 140 and refrigeration system 300.

Hereinafter, refrigeration system 300 according to the first embodiment of the present invention is explained with reference to FIGS. 4 to 6.

Figure 4:
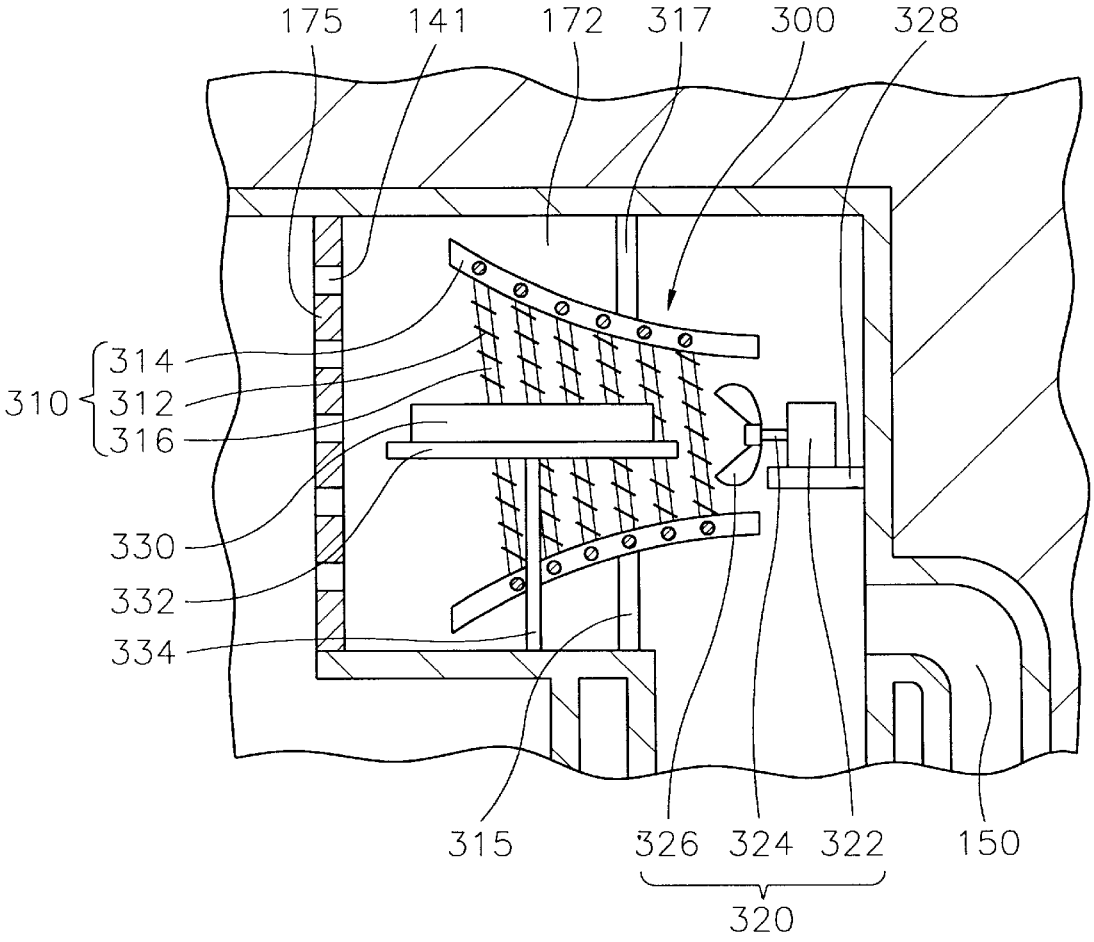
FIG. 4 is an enlarged sectional view of a refrigeration system shown in FIG. 3.

As shown in FIG. 4, refrigeration system 300 comprises an evaporator 310 disposed in evaporator chamber 172 so as to generate the chilled air, a blower assembly 320 which is coaxially disposed with evaporator 310 so as to blow an air toward evaporator 310, and a heater 330 for removing a frost adhering to evaporator 310. Blower assembly 320 is located at a rear of evaporator 310. Evaporator 310 has a helical shape forming a conical space portion therein, and heater 330 is coaxially disposed in the conical space portion.

Figure 5:
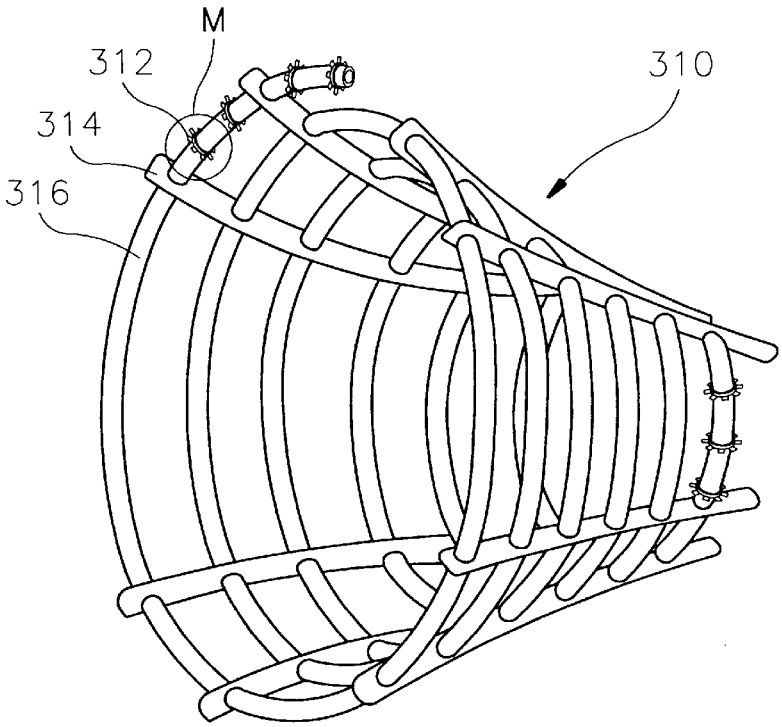
FIG. 5 is a perspective view of an evaporator according to the first embodiment of the present invention.
Figure 6:
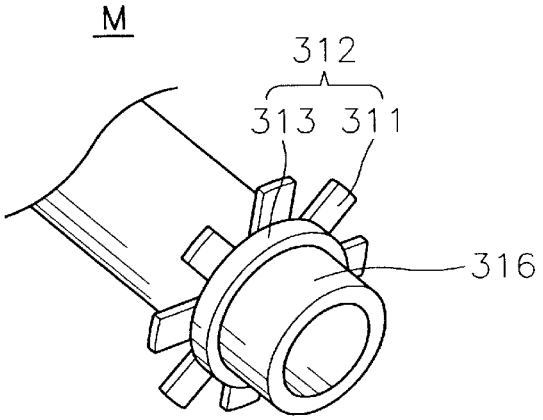
FIG. 6 is an enlarged perspective view of an "M" portion shown in FIG. 5, in which a heat exchange pin according to the first embodiment of the present invention is disposed around a refrigerant pipe.

As detailedly shown in FIG. 5, evaporator 310 includes a refrigerant pipe 316 having a spiral shape which becomes larger towards second partition wall 175, at least one bracket 314 coupled to upper and lower portions of refrigerant pipe 316 for supporting refrigerant pipe 316, and a plurality of heat exchange pins 312 which are disposed around refrigerant pipe 316 in the longitudinal direction thereof.

Refrigerant pipe 316 is wound by passing through support bracket 314, and the helical shape of refrigerant pipe 316 is supported by support bracket 314. Refrigerant pipe 316 has a first end connected to the condenser and a second end connected to compressor 140, thereby forming a circulation route for the refrigerant gas.

Heat exchange pins 312 increase a heat-exchange area between the air and evaporator 310. As shown in FIG. 6, each heat exchange pin 312 includes a ring portion 313 which is disposed around refrigerant pipe 316 and a plurality of ribbons 311 which are radially and integrally formed at one end of ring portion 313.

Referring again to FIG. 4, a first suspension bar 315 is installed between support bracket 314 and an upper wall of evaporator chamber 172, and a second suspension bar 317 is installed between support bracket 314 and a bottom wall of evaporator chamber 172. Evaporator 310 is suspended in evaporator chamber 172 by first and second suspension bars 315 and 317.

Blower assembly 320 includes a motor 322 having a rotating shaft 324, and a fan 326 which is coupled to rotating shaft 324 so as to be rotated. In order to stably install motor 322 in evaporator chamber 172, a ledge portion 328 is integrally formed at a predetermined portion of a rear wall of evaporator chamber 172. Motor 322 is installed on ledge portion 328.

In addition, a support bar 334 extending from the bottom wall of evaporator chamber 172 to the conical space portion of evaporator 310 is fixed to the bottom wall of evaporator chamber 172, and a support plate 332 is integrally formed on an upper end of support bar 334. Heater 330 is installed on support plate 332.

Refrigerator 200 having refrigeration system 300 constructed as mentioned above operates as follows.

Firstly, when an electric power is applied to refrigerator 200, compressor 140 circulates the refrigerant gas into the condenser by compressing the refrigerant gas. Then, while passing through the condenser, the refrigerant gas is changed to a liquid phase refrigerant, and the liquid phase refrigerant is supplied into evaporator 310. The liquid phase refrigerant is evaporated in refrigerant pipe 316, thereby absorbing a heat from periphery thereof. As a result, the chilled air is created in the periphery of evaporator 310.

At the same time, blower assembly 320 blows the air towards evaporator 310. Since blower assembly 320 is coaxially disposed at the rear of evaporator 310, the air blown by blower assembly 320 widely makes contact with evaporator 310. At this time, due to the helical shape of evaporator 310, some of the air may rotate about a central axis of refrigerant pipe 316. Accordingly, a turbulent air flow is generated when the air passes through evaporator 310, so the air further uniformly makes contact with evaporator 310, so the heat-exchange efficiency is improved.

In addition, heat exchange pins 312 disposed around refrigerant pipe 316 not only increase the heat-exchange area between evaporator 310 and the air, but also distributes the turbulent air flow, so the heat-exchange efficiency is further improved.

As a result, the chilled air created by a heat-exchange between evaporator 310 and the air is supplied into freezing chamber 120 through first chilled air inlet 141 formed in second partition wall 175. At this time, since the turbulent chilled air is supplied to freezing chamber 120, freezing chamber 120 can be uniformly cooled.

On the other hand, some of the chilled air is introduced into refrigerating chamber 130 through chilled air duct 150 and second chilled air inlet 142. The chilled air which has been introduced into freezing and refrigerating chambers 120 and 130 is re-circulated into evaporator chamber 172 through first and second chilled air return passages 143 and 144 which are formed at the lower portion of freezing chamber 120 and the upper portion of refrigerating chamber 130, respectively.

While the refrigerating cycle is being carried out, if it is required to remove the frost adhering to evaporator 310, an electrical control unit (not shown) sends an operating signal to heater 330 so as to operate heater 330. Since heater 330 is coaxially disposed in evaporator 310, heater 330 can uniformly distribute a heat toward evaporator 310, so the frost adhering to evaporator 310 is effectively defrosted.

Figure 7:
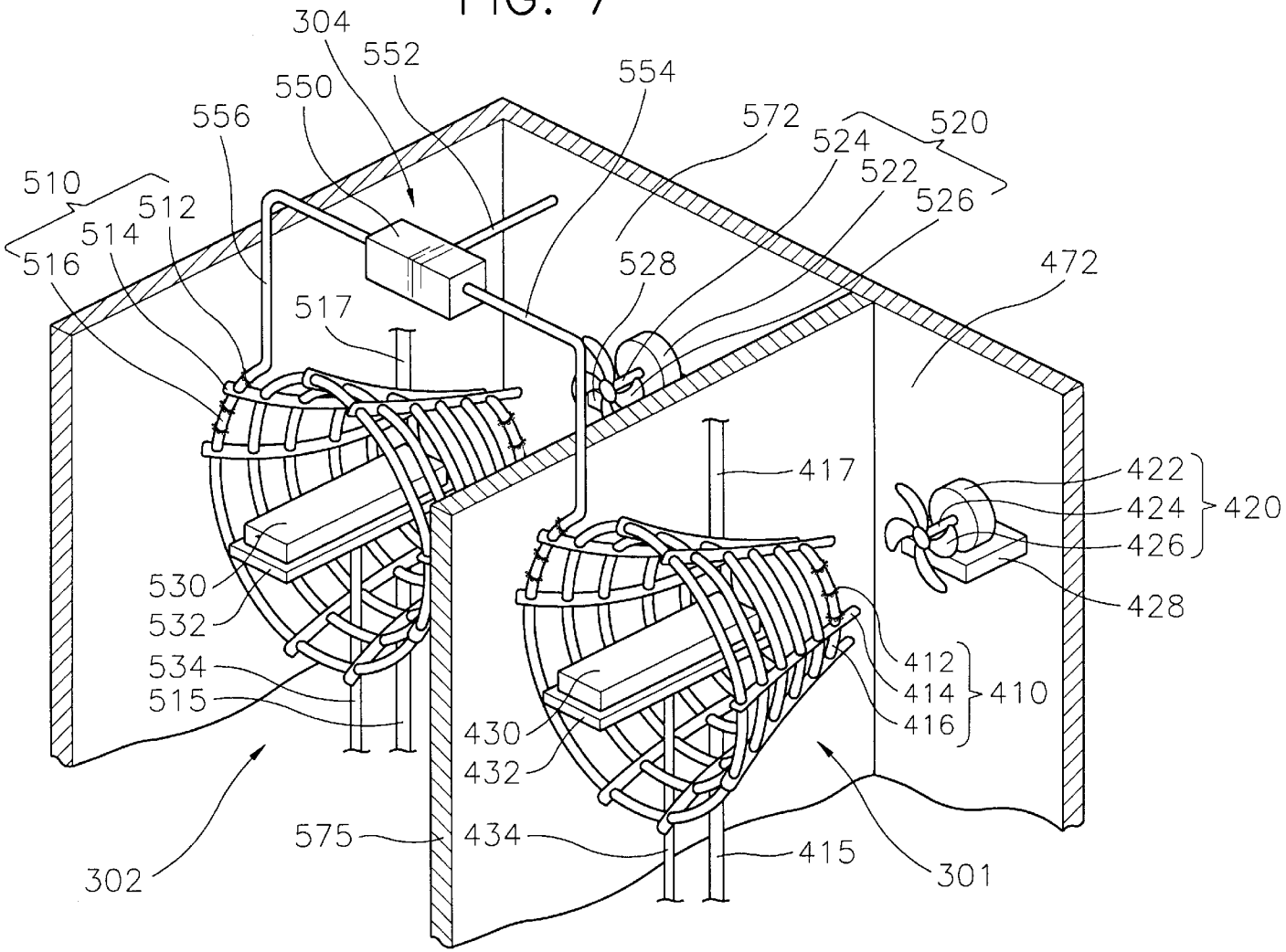
FIG. 7 is a perspective view of a refrigeration system according to the second embodiment of the present invention.

FIG. 7 shows a refrigeration system 500 according to a second embodiment of the present invention. In this embodiment, evaporator chamber 172 is divided into first and second evaporator chambers 472 and 572 by a third partition wall 575. First and second refrigeration apparatuses 301 and 302 having structures similar to the structure of refrigeration system 300 of the first embodiment are respectively installed in first and second evaporator chambers 472 and 572. First refrigeration apparatus 301 includes a second evaporator 410, a second blower assembly 420 and a second heater 430, and second refrigeration apparatus 302 includes a third evaporator 510, a third blower assembly 520 and a third heater 530.

Second evaporator 410 comprises a second refrigerant pipe 416 having a spiral shape, at least one second support bracket 414 for supporting refrigerant pipe 416, and a plurality of second heat exchange pins 412 which are disposed around second refrigerant pipe 416. Each second heat exchange pin 412 includes a ring portion and a plurality of ribbons which are radially and integrally formed at one end of the ring portion. Second evaporator 410 further includes a third suspension bar 415 installed between second support bracket 414 and an upper wall of first evaporator chamber 472, and a fourth suspension bar 417 installed between support bracket 414 and a bottom wall of first evaporator chamber 472 respectively. Second evaporator 410 is suspended in first evaporator chamber 472 by third and fourth suspension bars 415 and 417.

Second blower assembly 420 includes a second motor 422 having a second rotating shaft 424, and a second fan 426 which is coupled to second rotating shaft 424 and is driven by second motor 422. Second ledge portion 428 is integrally formed at a predetermined portion of a rear wall of first evaporator chamber 472 so as to install second motor 422 thereon.

Second heater 430 is installed on second support plate 432 which is integrally formed on an end of a second support bar 434.

Third evaporator 510 comprises a third refrigerant pipe 516 having a spiral shape, at least one third support bracket 514 for supporting third refrigerant pipe 516, and a plurality of third heat exchange pins 512 which are disposed around third refrigerant pipe 516. Each third heat exchange pin 512 includes a ring portion and a plurality of ribbons which are radially and integrally formed at one end of the ring portion. Third evaporator 510 further includes a fifth suspension bar 515 installed between third support bracket 514 and an upper wall of second evaporator chamber 572, and a sixth suspension bar 517 installed between third support bracket 514 and a bottom wall of second evaporator chamber 572 respectively. Third evaporator 510 is suspended in second evaporator chamber 572 by fifth and sixth suspension bars 515 and 517.

Third blower assembly 520 includes a third motor 522 having a third rotating shaft 524, and a third fan 526 which is coupled to third rotating shaft 524 and is driven by third motor 522. Third ledge portion 528 is integrally formed at predetermined portion of a rear wall of second evaporator chamber 572 so as to install third motor 522 thereon.

Third heater 530 is installed on third support plate 532 which is integrally formed on an end of a third support bar 534.

The structures and arrangements of the above elements of first and second refrigeration apparatuses 301 and 302 are the same as the structure and arrangement of the elements of refrigeration system 300 according to the first embodiment of the present invention. Accordingly, the structures and arrangements of first and second refrigeration apparatuses 301 and 302 will not be further described below.

Refrigeration system 500 further comprises a valve assembly 304 for permitting the refrigerant gas to selectively flow into one of first and second evaporators 410 and 510 while a defrosting operation is being carried out.

Valve assembly 304 includes a solenoid valve 550 which receives an operating signal from the electrical control unit, a first refrigerant duct 552 having a first end connected to the condenser and a second end connected to solenoid valve 550, a second refrigerant duct 554 having a third end connected to solenoid valve 550 and a fourth end connected to first evaporator 410, and a third refrigerant duct 550 having a fifth end connected to solenoid valve 550 and a sixth valve connected to second evaporator 510.

Solenoid valve 550 selectively closes one of first and second refrigerant ducts 552 and 554 when the operating signal is sent thereto from the electrical control unit. At this time, only the evaporator receiving the refrigerant gas is operated. Then, the electrical control unit sends an operating signal to the heater which is installed in the conical space portion of the evaporator which is in a non-operated condition, so the heater heats the evaporator, thereby defrosting the frost adhering to the evaporator. While the defrosting operation is being carried out in one evaporator, the cooling operation of refrigeration system 500 is continuously carried out by the other evaporator so that cooling efficiency is improved.

As described above, the refrigeration system according to the present invention can effectively make a heat-exchange between the evaporator and the air so that the cooling efficiency is improved.

In addition, since the turbulent air flow is introduced into the freezing chamber, the freezing chamber can be uniformly cooled. Further, since the heater is coaxially disposed in the evaporator, the heater can uniformly heat the evaporator, so the defrosting of the frost from the evaporator is effectively carried out.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A refrigerator comprising:

a cabinet having a refrigerating chamber, a freezing chamber which is disposed above the refrigerating chamber and separated from the refrigerating chamber by a first partition wall, and an evaporator chamber which is disposed at a rear portion of the freezing chamber and is separated from the freezing chamber by a second partition wall;

a first means for generating a chilled air, the first means being disposed in the evaporator chamber and having a helical shape forming a conical space portion therein;

a second means for blowing an air towards the first means, the second means being coaxially disposed with the first means, the second means being located at a rear of the first means; and a third means for removing a frost adhering to the first means, the third means being installed in the conical space portion.

2. The refrigerator as claimed in claim 1, wherein the first means includes an evaporator comprising a refrigerant pipe having a spiral shape which becomes larger towards the second partition wall, at least one upper bracket coupled to an upper portion of the refrigerant pipe, for supporting the refrigerant pipe, at least one lower bracket coupled to a lower portion of the refrigerant pipe, for supporting the refrigerant pipe, and a plurality of heat exchange pins which are disposed around the refrigerant pipe in a longitudinal direction thereof.

3. The refrigerator as claimed in claim 2, wherein each heat exchange pin includes a ring portion which is disposed around the refrigerant pipe and a plurality of ribbons which are radially and integrally formed at one end of the ring portion.

4. The refrigerator as claimed in claim 2, further comprising a first suspension bar installed between the upper bracket and an upper wall of the evaporator chamber, and a second suspension bar installed between the lower bracket and a bottom wall of the evaporator chamber, the evaporator being suspended in the evaporator chamber by the first and second suspension bars.

5. The refrigerator as claimed in claim 2, wherein the second means includes a motor having a rotating shaft, and a fan which is coupled to the rotating shaft and is driven by the motor.

6. The refrigerator as claimed in claim 5, further comprising a ledge portion which is integrally formed at a predetermined portion of a rear wall of the evaporator chamber, the motor being installed on the ledge portion.

7. The refrigerator as claimed in claim 5, wherein the third means includes a heater which is coaxially disposed with the evaporator.

8. The refrigerator as claimed in claim 7, further comprising a support bar extending from the bottom wall of the evaporator chamber to the conical space portion of the evaporator, and a support plate integrally formed on an upper end of the support bar, the heater being installed on the support plate.

9. A refrigerator comprising:

a cabinet having a refrigerating chamber, a freezing chamber which is disposed above the refrigerating chamber, and an evaporator chamber which is disposed at a rear portion of the freezing chamber, the evaporator chamber being separated from the freezing chamber by a first partition wall and divided into a first evaporator chamber and a second evaporator by a second partition wall;

a compressor for compressing a refrigerant gas, and then for circulating the refrigerant gas, the compressor being disposed at a lower portion of the cabinet;

a condenser for condensing the refrigerant gas, the condenser being connected to the compressor;

first and second evaporators for generating a chilled air, the first and second evaporators having helical shapes forming first and second conical space portions therein, respectively;

first and second blower assemblies for blowing an air towards the first and second evaporators respectively, the first and second blower assemblies being coaxially disposed with the first and second evaporators respectively, the first and second blower assemblies being located at rear portions of the first and second evaporators, respectively;

first and second heaters for removing a frost adhering to the first and second evaporators, the first and second heaters being installed in the first and second conical space portions, respectively; and a valve assembly for permitting the refrigerant gas to selectively flow into one of the first and second evaporators while a defrosting operation is being carried out.

10. The refrigerator as claimed in claim 9, wherein the valve assembly includes a solenoid valve which receives an operating signal from an electrical control unit, a first refrigerant duct having a first end connected to the condenser and a second end connected to the solenoid valve, a second refrigerant duct having a third end connected to the solenoid valve and a fourth end connected to the first evaporator, and a third refrigerant duct having a fifth end connected to the solenoid valve and a sixth valve connected to the second evaporator, the solenoid valve selectively closing one of the first and second refrigerant ducts when the operating signal is sent thereto from the electrical control unit.

11. The refrigerator as claimed in claim 10, wherein each of the first and second evaporators includes a refrigerant pipe having a spiral shape which becomes larger toward the first partition wall, at least one upper bracket coupled to an upper portion of the refrigerant pipe, for supporting the refrigerant pipe, at least one lower bracket coupled to a lower portion of the refrigerant pipe, for supporting the refrigerant pipe, and a plurality of heat exchange pins which are disposed around the refrigerant pipe in a longitudinal direction thereof, the fourth end of the second refrigerant duct being connected to the refrigerant pipe of the first evaporator, the sixth end of the third refrigerant duct being connected to the refrigerant pipe of the second evaporator.

12. The refrigerator as claimed in claim 11, wherein each heat exchange pin includes a ring portion which is disposed around the refrigerant pipe and a plurality of ribbons which are radially and integrally formed at one end of the ring portion.

13. The refrigerator as claimed in claim 11, wherein each of the first and second evaporators includes a first suspension bar installed between the upper bracket and an upper wall of the evaporator chamber, and a second suspension bar installed between the lower bracket and a bottom wall of the evaporator chamber, the first and second evaporators being suspended in the first and second evaporator chambers by the first and second suspension bars, respectively.

14. The refrigerator as claimed in claim 11, wherein each of the first and second blower assemblies includes a motor having a rotating shaft, and a fan which is coupled to the rotating shaft and is driven by the motor.

15. The refrigerator as claimed in claim 14, further comprising first and second ledge portions which are integrally formed at predetermined portions of rear walls of the first and second evaporator chambers, respectively, the motor of the first blower assembly being installed on the first ledge portion, the motor of the second blower assembly being installed on the second ledge portion.

16. The refrigerator as claimed in claim 15, wherein the first and second heaters are coaxially disposed with the first and second evaporators, respectively.

17. The refrigerator as claimed in claim 14, further comprising a first support bar extending from the bottom wall of the first evaporator chamber to the first conical space portion of the first evaporator, a second support bar extending from the bottom wall of the second evaporator chamber to the second conical space portion of the second evaporator, a first support plate integrally formed on an upper end of the first support bar, and a second support plate integrally formed on an upper end of the second support bar, the first and second heaters being installed on the first and second support plates, respectively.

* * * * *